United States Patent [19]

Cohen

[11] 4,223,456

[45] Sep. 23, 1980

[54] SHOE SOLE ASSEMBLY

[76] Inventor: Jacques Cohen, 2 Rue Marechal Harispe, Paris, France, 75007

[21] Appl. No.: 1,190

[22] Filed: Jan. 5, 1979

[51] Int. Cl.[2] ..... A43B 13/20; A43B 7/08; A43B 13/04

[52] U.S. Cl. ..... 36/29; 36/3 B; 36/32 R; 36/59 R

[58] Field of Search ..... 36/28, 29, 32 R, 3 R, 36/3 B, 59 R, 59 C

[56] References Cited

U.S. PATENT DOCUMENTS

| | | | |
|---|---|---|---|
| 2,553,616 | 5/1951 | Walls | 36/29 |
| 4,041,618 | 8/1977 | Famolare, Jr. | 36/29 X |

FOREIGN PATENT DOCUMENTS

| | | | |
|---|---|---|---|
| 2342677 | 9/1977 | France | 36/29 |
| 17099 | of 1901 | United Kingdom | 36/29 |

*Primary Examiner*—James Kee Chi
*Attorney, Agent, or Firm*—Martin Smolowitz

[57] ABSTRACT

A shoe sole assembly of a resilient material body portion provided with absorbers energy formed as part of the body portion. The energy absorbers are defined by vertically disposed, spaced apart cell members extending from an upper surface to beyond a lower surface of the body portion to provide a bounded space. Each cell member is formed of an hollow compartment extending in part for the thickness of the body portion with its length depending upon the sole profile, the first end of the respective compartments at the upper surface of the sole body portion is initially open ended; whereas a hollow protuberance structure is at the lower surface of the body portion to enclose each cylindrical compartment at a second end. The protuberances extend beyond the lower surface to form contact areas with the ground surface when the sole assembly is used as part of a shoe. The compartments are separated from one another by adjacent lands which at the upper sole surface provide define respective substrate areas for the disposition of an inner sole thereon, so to seal each cell member with a volume of air trapped in the bounded space of the compartment and associated hollow protuberance structure.

6 Claims, 10 Drawing Figures

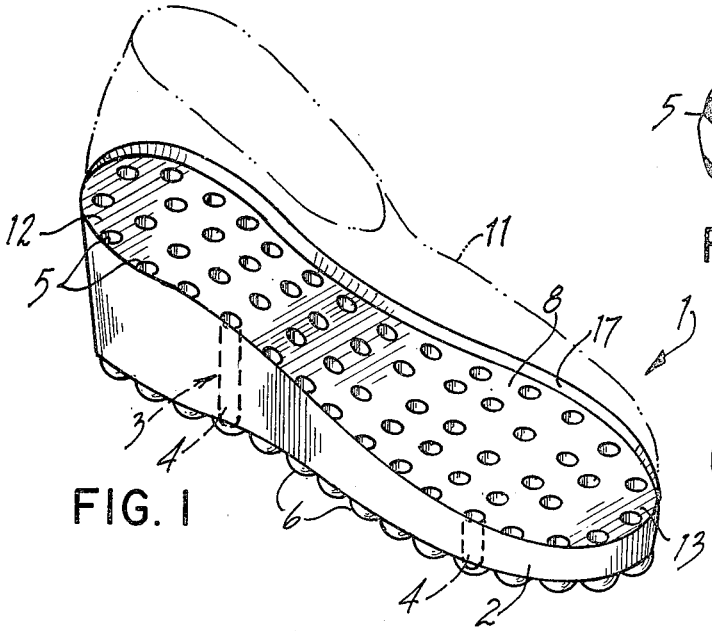
FIG. 1
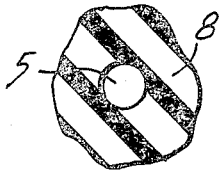
FIG. 7A
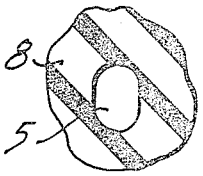
FIG. 7B
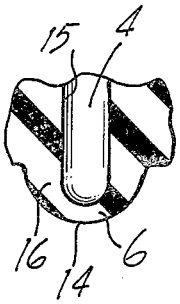
FIG. 6A
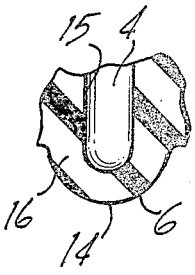
FIG. 6B
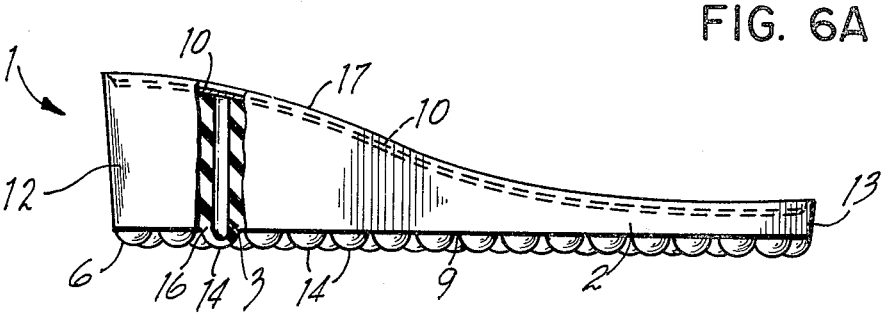
FIG. 2A
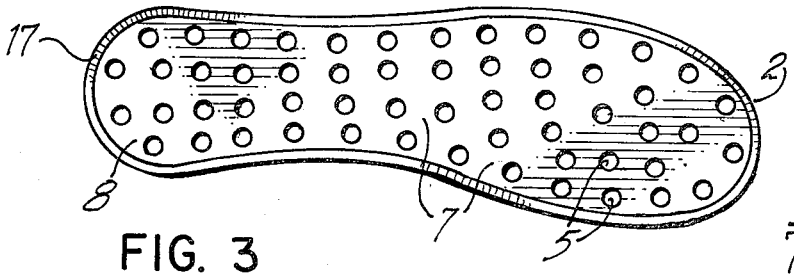
FIG. 3
FIG. 5
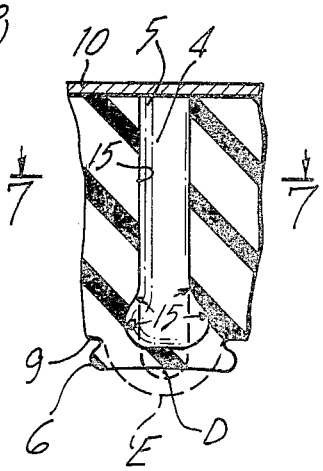
FIG. 4
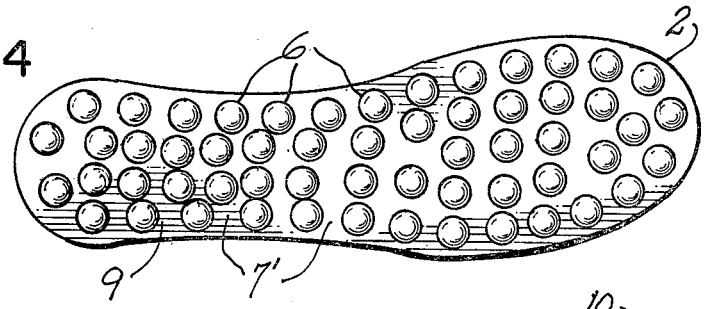
FIG. 2B
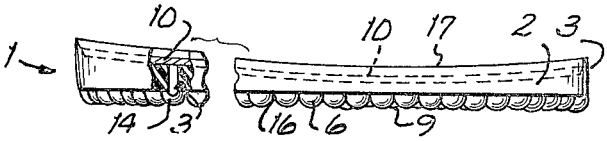

SHOE SOLE ASSEMBLY

BACKGROUND OF THE INVENTION

The present invention is directed to an improved shoe sole assembly. More particularly, to a shoe sole assembly formed with a plurality of members disposed along the working surfaces of the sole assembly which act as energy absorbers.

The prior art is replete with illustrations employing various arrangements as part of the total shoe, be it as part of the inner sole or the outer outer sole structure, where means are joined with the shoe for accommodating the anatomical characteristics of the user so as to render walking and movement generally as favorably as possible depending upon the circumstances. U.S. Pat. Nos. 2,033,313 (Wilson); 2,090,881 (Wilson), 2,627,676 (Hack) and 4,012,855 (Gardner); all employ some form of structure which is attached to a typical shoe usually at the outer surface of the sole or as an insole, to provide a cushioning effect to footwear.

The Wilson patent 2,033,313 has a tread portion with air between the tread and the upper surface of a sole or heel. Compressible columns are formed therebetween to provide a cushioning effect; whereas, Wilson 2,090,881 covers another embodiment employing a substrate for attachment to a sole surface, the substrate has connected on its surface air filled pockets, that depend therefrom, the axial extent of the pockets varying according to the sole curvature.

The Hack Pat. No. 2,627,676 which has a sole which is in the form of an undulating corrugated sole with air trapped within the corrugations providing a cushion when compressed. Gardner (U.S. Pat. No. 4,102,855) employs a sole surface with honeycomb arrangement of rectangular cross-section cavities over which is laid a series of compressible members to form a cushioning air pocket composite on the outer surface of the sole.

All of the aforementioned art while employing some form of structure as an adjunct to the basic sole structure, fail to provide a basis by which the shoe sole may be formed with shock absorbing characteristics free of the need to externally substantially build up the outer surface of a sole. This is especially true when employing sole profiles other than those which are relatively thin and generally uniform in thickness.

It has been common place in the manufacture of such prior art soles to employ multi-step manufacturing processes whereby the basic sole substrate is in some fashion adapted by cementing or in some way affixing thereto, various media for achieving the aforementioned results. In so doing, the costs become high and the ability to simply and efficiently manufacture a sole structure exhibiting favorable characteristics is not accomplished.

The approaches suggested in the prior art fail to provide the necessary structure for the inexpensive manufacture of shoe sole assemblies such as exemplified by the present invention, which are capable of being employed in diversly profiled soles and are particularly pleasing to the eye and can be acceptable for high fashion designer shoes.

While it is recognized that the prior art has endeavored to consider the problem of providing for a smoother and comfortable shoe through the use of various techniques for the dissipation of forces acting upon the anatomy during the movement of a user in his shoes; nonetheless, prior art approaches have failed to concern themselves with the ability to formulate a sole structure designed to accommodate in a precise fashion diverse show sole profile configurations particularly useful in the use of high fashion shoes. In particular, where for example, a wedge type platform shoe construction is called for, the prior art would teach the use of some type of media entirely to the outside surfaces of the sole conforming to the required profile. The highest portion occurring at the heel area of the sole would for example, have such members at maximum extension externally of the sole giving rise to problems concerning strength and shoe stability. The ability to use the inventive features as hereinafter described with sole shoe profile and configurations of any type and while exhibiting, stability, favorable energy absorbing characteristics, and extended wear is what the present invention is concerned with.

The use of resilient materials with memory in a fashion which enables the sole assembly to be formed in accordance with the present invention, is important in the design, operativeness and manufacture of shoe sole assemblies of the type covered by the present invention. Much evaluation of materials has been necessary since the structure according to the invention, must exhibit certain physical and mechanical properties which are repeatable over a long time span, enabling it to perform in a new and novel fashion.

SUMMARY OF THE INVENTION

Accordingly, it is the main object of the present invention to overcome the defects of the prior art.

It is still another object of the present invention to provide for a shoe sole assembly formed with a plurality energy absorbing members extending from the respective surfaces of the sole, so as to be more comfortable and stress free to the user than heretofor possible.

It is still another object of the present invention to provide a unitary shoe sole assembly employing a plurality of cell members which are part of the total sole structure, that function to dissipate the stressing forces of the sole by a user with respect to a ground surface.

Still a further object of the present invention is to provide for a shoe sole assembly of one piece construction formed with a plurality of cell members each having a corresponding number of protuberances extending beyond the lower surface of the sole, for providing contact areas with the ground to enable the dissipation of opposing upward forces to the cell members during sole contact with the ground.

Still another object of the present invention is to provide for a readily manufacturable shoe sole assembly formed of resilient material which is capable of being mass produced at reasonable cost.

A major feature of the present invention is directed to a shoe sole assembly of resilient material formed of a body portion provided with energy absorbing means formed as part of said body portion, said assembly including: a plurality of vertically disposed spaced apart cell members extending from an upper surface to beyond a lower surface of said body portion, to provide a bounded space; each of said respective cell members having an elongated hollow compartment extending in part for the thickness of said body portion, the length of which depending upon sole profile, a first end of said respective compartments at the upper surface of said sole body portion being initially open ended; hollow protuberance means formed at the lower surface of said body portion enclosing each of said compartments at a second end, said protuberance means extending beyond the lower surface of said body portion to form contact areas with the ground surface when said sole assembly is used as part of a shoe; and each of said compartments being separated from one another by adjacent land areas which at said upper sole surface provide respective substrate areas for the disposition of an inner sole thereon, for sealing each of said cell members with a volume of air trapped in the bounded space of the compartment and associated hollow protuberance means.

Shock absorbing and buoyancy is afforded to the user by the combination of the resilient material and the sealed air in the cell members. The user is protected from the high, short duration forces created when the foot reacts with the ground; firstly because the selected sole material can be elastically deformed. As with any elastomeric shock absorber, the impact energy is absorbed and dissipated within the material as its geometry is altered.

A second type of shock absorber analgous to a pneumatic snubber is provided in the sole construction by the plurality of closed air cell members. The entrapped air compresses as the cell members deform and the energy to move the air molecules is dissipated as heat. The air shock absorber is a "softer" type of energy absorber, thereby giving the user a feeling of greater buoyancy than heretofore possible.

Also within the scope of the invention is a sole assembly, where said cell members are formed of material having a memory for returning to an original stress free condition.

Still a further feature of the present invention is directed to an improved shoe structure having an upper portion, and inner sole, and a sole assembly, said shoe structure including: a body portion formed of resilient material provided with energy absorbing means in spaced apart relation for the entire length and width thereof; formed as part of said body portion, said assembly being further defined by, a plurality of cell members extending from an upper surface to a lower surface of said body portion, each of said respective cell members having a shaped chamber extending for the thickness of said body portion; a first end of said respective chambers at the upper surface of said sole body portion being open ended; hollow protuberance means formed at the lower surface of said body portion enclosing each of said chambers, at a second end, said protuberance means extending beyond the lower surface of said body portion to form sole contact areas with the ground surface when in use and each of said cell members being separated from one another by adjacent land areas which at the upper surface of said body portion defines respective substrate areas for the disposition of an inner sole thereon, to seal each of said cell members with a volume of air trapped in the bounded space of each chamber and associated hollow protuberance means.

Other features of the present invention will be more readily understood with respect to the accompanying specification claims and drawings.

IN THE DRAWINGS

FIG. 1 is a pictorial view of the sole assembly of the present invention;

FIG. 2A is a side elevational view of a sole assembly being of a general wedge shape including a partial section showing one cell member of the invention;

FIG. 2B is a fragmented side elevational view of a sole assembly having a body portion substantially of a uniform thickness along its sole length;

FIG. 3 is a top view of the sole assembly;

FIG. 4 is a bottom view of the sole assembly;

FIG. 5 is a section view of a cell member in a compressed and relaxed condition;

FIG. 6 is a cross section of the protuberance showing a varying wall thickness;

FIG. 6*b* is a cross section of the protuberance showing a uniform wall thickness;

FIG. 7 is a sectional view along line 7—7 in FIG. 5 showing a compartment having a circular cross section;

FIG. 7*b* is a sectional view along line 7—7 in FIG. 5 showing a compartment having an oval cross-section.

DESCRIPTION OF THE INVENTION

As can be seen from FIGS. 1 and 2 the sole assembly structure 1 is formed of a body member 2 having a plurality of vertically disposed, spaced apart cells 3 which are formed of individual cylindrically shaped hollow compartments 4 having an opening 5 at the upper surface 8 and a protuberance 6 at the opposite end. Each compartment 4 can best be described as bounded space formed integrally with the body member 2 for the entire thickness of the sole assembly 1 having a depth at any given point determined by the profile of the sole assembly 1. This can best be seen in the top view of FIG. 3. Land areas 7 are between each of the various openings 5 which exist throughout the entire upper surface 8. The lower surface 9 of the sole assembly 1 has land areas 7' between each of the protuberances 6. It will be noted from FIG. 4 that the spaced protuberances 6 extend along the entire surface areas of the lower surface 9 of the sole assembly 1. Each protuberance 6 is disposed at an opposite end of the opening 5 for corresponding compartments 4. The land areas 7' between the respective protuberances are generally smaller than the comparable land areas 7 existing at the upper surface 8 as seen in FIG. 3. This arises from the fact that each of the respective protuberances 6 extend beyond the width of the lower openings at surface 9 in the compartment 4. The protuberances 6 consequently comprise a substantial portion of the total surface area of the lower surface 9. Each of the protuberances 6 are equal in extension from the lower surface 9 having a thickness which may depending on design requirements be constant or which varies; for example, the thickness may vary from the base portion 16 in proximity to the lower surface 9 of the sole assembly 1 to its highest point which is furtherest away from the lower surface 9 (see FIGS. 6*a* and 6*b*).

The thickest portion would exist at juncture 16 with the lower surface 9 and the thinnest at contact areas 14 which are furthest from the lower surface of the sole 9. The upper surface 8 is provided with a flange structure 17 that extends about the entire periphery of the sole assembly 1 and acts to properly receive and position an inner sole 10 and an upper shoe structure 1 as is seen in FIGS. 1 and 2. The various cells 3 formed as part of the entire sole assembly 1, vary in accordance with the thickness of the sole body portion 2. For example, in the generally wedged shaped sole assembly as seen in FIG. 1, the lengths of the various compartments 4 in the heel section 12 of the sole assembly 1 are greater when compared to those existing in the toe section 13. Obviously, any variation in sole profile configuration will effect the total structure of cells 3. In this regard, the invention can be employed in instances where the body portion 2 is substantially of a uniform thickness for its length.

The configuration of the sole assembly 1 wherein the heel section 12 is thicker and has longer cells 3 than the forward portion of the sole assembly gives rise to a feature beneficial to the user. The protection under heel section 12 is in closer alignment with the skeletal structure is "softer" than the toe portion. The relative "softness" of portions of the sole assembly 1 can further be adjusted by forming cells 3 of varying diameters across the sole surface.

In general, the larger the cell volume, the more air entrapped therein. The relative compression of the air is proportional to the initial cell volume and therefore the energy absorbing capabilities are equally proportional to the cell volume.

It is to be noted, that the inner sole 10 is affixed to a substrate in the land areas 7 at the upper surface 8, where the placement of such inner sole seals the respective compartments 4 so as to trap air in the bounded space formed by the cylindrically shaped compartments 4 and the associated protuberances 6. The compartments 4 are preferably cylindrically shaped having a circular cross section, but oval and other cross-sectional geometry can be utilized (see FIGS. *7a* and *7b*). The protuberances 6 are formed perferably as hollow hemispherical members and are an integral part of the one piece sole assembly 1.

Manufacture of sole assembly 1 is preferably by injection molding enabling controlled precise design parameters to be maintained, while assuring economical manufacture.

The sole assembly of the present invention is of an elastically deformable resilient material having memory and it has been found that such materials as: crepe rubber, polyvinyl chloride and polyurethene rubber, have exhibited the most suitable mechanical and physical properties required for the present invention. This arises from the fact that during use of the inventive sole assembly as part of a shoe structure, the protuberances 6 come into contact with the ground surface along given section of the lower surface 6 and must exhibit a number of characteristics which are essential to successful energy absorbtion by sole assembly 1.

The protuberances 6 comprising a resilient material and exhibit flexure upon being stressed as shown in FIG. 5. The upward force upon impingement with the ground causes protuberance 6 to deflect inwardly to compress the trapped air within the respective compartment 4. While in motion, there is transmission of pressure by the bone and tissue of the skelton through the sole to the ground and it is desirable to spread the pressure to minimize concentration. If effect, it is desirable to dissipate the shock energy within sole assembly 1 when contact is made with the ground by the shoe. Under stress, contact areas 14 at the highest point of the protuberances 6 communicate with the ground causing protuberances 6 to deflect inwardly as at point D in FIG. 5, this in turn causes deformation of the respective compartment walls 15, which act as an energy absorbers during the period of stress. The deflection of the protuberances 6 and the consequent absorbtion of the contact forces by the cell members, otherwise transmittable to human anatomy, provides for absorbtion of these forces. In effect, the invention provides structure adapted to react to the anatomical features of the feet with changing stress. Once the the contact areas 14 of the respective protuberances 6 are no longer in a stressed condition they relax and deflect outwardly as seen in E of FIG. 5; and assume their original extended position at the lower surface 9 of the sole assembly 1. It should be understood, while other materials including certain plastic and polymeric compounds may achieve favorable results with respect to the present invention, the materials employed for sole assembly 1, such as: crepe rubber; polyvinyl chloride; and polyurethane rubber; all affording good flexibility, elasticity, shock absorption and abrasion resistance properties have performed best under repeated stress.

The configuration of the sole assembly 1 employing various compartment lengths 4 forming the cell members 3, provides a basis by which the favorable energy absorbing characteristics of the present invention are obtainable, while at the same time forming an intergrally shaped commercially suitable sole assembly profile which is satisfactory in terms of strength and flexure characteristics and provides comfort to the user. Each of the cell members 3 has a maximum length in the vertical direction which is determined by the distance from the upper surface 8 of the body portion 2 through to the lowest most surfaces of the hollow protuberance 6. The respective protuberances 6 at the point of juncture with the lower surface 9 totally surrounds the second end of compartments 4 and at that point has a thickened portion 16 so as to provide the necessary strength enabling long life and continuous flexture of the protuberances 6. Furthermore, the present invention is able to provide differing sole structure, so as to accommodate changing styling and design requirements dictated by commercial acceptance, while maintaining favorable qualities through the specific contouring of the sole assembly profile. At the same time the protuberances 6 are of a constant extension so as to aide in the stability and strength of the total shoe structure.

BEST MODE OF THE INVENTION

The shoe sole assembly 1 has a body portion 2 provided with energy absorbers in the form of cell members 3 that are vertically disposed and in spaced apart relation formed as part of the body portion 2. A plurality of these members 3 extend from an upper surface 8 to beyond a lower surface 9 of body portion 2 to provide a bounded space. Each of said respective members 3 have a cylindrically shaped hollow compartment 4 extending in part for the thickness of the body portion with its length depending upon the sole profile. A first end of respective compartments at the upper surface 8 is open ended at 5 and a hollow protuberance 6 is formed at the lower surface 9 of the body portion 2 enclosing each of the cylindrical compartments 4 at a second end. The protuberances 6 extend beyond the lower surface 9 to form contact areas 14 with the ground surface when the shoe is in use. Adjacent land areas 7 separate the openings 5 at the upper surface 8 to define substrate areas for the disposition of an inner sole 10 thereon, so to seal each of the cell members 3 with a volume of air trapped in the bounded space of the compartment 4 and associated hollow protuberance 6. The protuberance 6 is actionable upon impringement at its lowestmost surface 14 to provide for dissipation of forces in response to forces exerted on the anatomy through the shoe.

It is essential to appreciate that the total structure of the cell member 3 is formed of a hollow hemispherically shaped protuberance 6 at the lower surface 9 of the sole assembly 1 depending from a hollow cylindrically shaped compartment 4 formed within the body portion 2 of the sole assembly 1 and is sealed at an end opposite protuberance 6 by an inner sole member 10 so as to completely retain a designated amount of air within the bounded areas of the protuberance 6 and compartment 4. Air being a compressable fluid acts as an energy transfer medium to wall surfaces 15 and the surrounding areas of contact with compartment 4.

While the present invention has been shown and described with respect to the intended use of the sole assembly 1 with high fashion shoes particularly for example, shoes which are used as dress wear; nonetheless, the concepts and principles as set forth herein should be equally applicable in other areas such as, athletic type shoes.

It will be appreciated that various changes and modifications may be made in the foregoing sole assembly without departing from the spirit of the present invention and as many changes may be made in the embodiments herein set forth it being understood, that all matter described herein are to be interpreted as illustrative and not in a limiting sense.

What is claimed:

1. A shoe sole assembly of resilient material comprised of a body portion provided with energy absorbing means as part of said body portion, said assembly including: a plurality of vertically disposed closely spaced identical cell members extending respectively along the entire length of said body portion, said cell members are defined by a bounded space from an upper surface to beyond a lower surface of said body portion; each of said respective cell members having an elongated hollow compartment extending in part for the thickness of said body portion, the length of which depending upon sole profile; a first end of said respective compartments at the upper surface of said sole body portion being initially open ended; hollow protuberance means formed at the lower surface of said body portion enclosing each of said compartments at a second end, said protuberance means extending beyond the lower surface of said body portion to form contact areas with the ground surface when said sole assembly is used as part of a shoe; said protuberance means being hemispherically shaped, having a wall thickness which gradually diminishes from its base in proximity to the lower surface of said body portions to an upper most surface of said protuberance means, to allow said protuberance means to become actionable upon impringement at the lowest most surface with the ground, for urging corresponding inward deflection of respective protuberance means under stress, to thereby compress air within respective cell members and deflect a corresponding plurality of adjacent wall surfaces of said compartments through absorbtion of energy opposing shoe user movement and dissipation of shock energy by said cell members, said compartments being separated from one another by adjacent land areas which at said upper sole surface provide respective substrate areas for the disposition of an inner sole thereon, to seal each of said cell members with a volume of air trapped in the bounded space of the compartment and associated hollow protuberance means; and said sole upper surface being further defined by integrally formed flange means at the outer periphery thereof, for respectively positioning said inner sole and shoe upper upon said upper surface of said body portion.

2. A shoe sole assembly as claimed in claim 1 wherein: said elongated hollow compartments are oval in cross-section.

3. A shoe sole assembly as claimed in claim 1, wherein: said sole assembly is formed of a resilient material taken from the group consisting of: crepe rubber, polyvinyl chloride and polyurethane rubber.

4. A shoe sole assembly as claimed in claim 1, wherein: said body portion being formed of a generally wedge shaped profile with a heel section having a height greater than a section of said body portion extending from an arch area to the toe area of said assembly.

5. A shoe sole assembly as claimed in claim 1, wherein: said body portion being substantially of a uniform thickness for its length.

6. An improved shoe structure having an upper portion, an inner sole, and a sole assembly, said shoe structure including: a body portion formed of resilient material provided with energy absorbing means in spaced apart relation for the entire length and width thereof, formed as part of said body portion, said assembly being further defined by, a plurality of identical cell members extending respectively along the entire length of said body portion, said cell members are defined by a bounded spaced from an upper surface to a lower surface of said body portion, each of said respective cell members having a chamber extending for the thickness of said body portion; a first end of said respective chambers at the upper surface of said sole body portion being open ended; hollow protuberance means formed at the lower surface of said body portion enclosing each of said chambers at a second end, said protuberance means being hemispherically shaped, having a wall thickness which gradually diminishes from its base in proximity to the lower surface of said body portions to an upper most surface of said protuberance means, to allow said protuberance means to become actionable upon impringement at the lowest most surface with the ground, for urging corresponding inward deflection of respective protuberance means under stress, to thereby compress air within respective cell members and deflect a corresponding plurality of adjacent wall surfaces of said compartments through absorbtion of energy opposing shoe user movement and dissipation of shock energy by said cell members, each of said cell members being separated from one another by land areas which at the upper surface of said body portion defines respective substrate areas for the disposition of an inner sole thereon, the seal each of said cell members with a volume of air trapped in the bounded space of each chamber and associated hollow protuberance means; and said sole upper surface being further defined by integrally formed flange means at the outer periphery thereof, for respectively positioning said inner sole and shoe upper upon said upper surface of said body portion.

* * * * *